United States Patent [19]

Simmons

[11] 4,048,809

[45] Sept. 20, 1977

[54] AIR CONDITIONING

[75] Inventor: Robert Sidney Simmons, Pinner, England

[73] Assignee: Casaire Limited, England

[21] Appl. No.: 636,902

[22] Filed: Dec. 2, 1975

[30] Foreign Application Priority Data

Dec. 2, 1974 United Kingdom ..... 52089/74

[51] Int. Cl.[2] ..... F25D 17/06; F25B 41/00; F24F 7/00; F24F 13/00

[52] U.S. Cl. ..... 62/89; 62/97; 62/122; 98/38 E

[58] Field of Search ..... 62/89, 97, 427; 98/38 E, 38; 239/433, 434.5

[56] References Cited

U.S. PATENT DOCUMENTS

| | | | |
|---|---|---|---|
| 1,296,968 | 3/1919 | Klein | 62/97 |
| 1,863,578 | 6/1932 | Morse et al. | 62/122 |
| 3,561,345 | 2/1971 | Kline et al. | 98/38 E |
| 3,792,595 | 2/1974 | Willis | 62/89 |

FOREIGN PATENT DOCUMENTS

| | | | |
|---|---|---|---|
| 1,154,341 | 10/1957 | France | 98/38 E |

*Primary Examiner*—Lloyd L. King
*Attorney, Agent, or Firm*—Pollock, Vande Sande & Priddy

[57] ABSTRACT

A method of cooling air in a space and air conditioning apparatus for carrying out this method. Primary air at a temperature much below the temperatures used in conventional systems, is mixed with secondary drawn from the space, the mixture then being introduced into the space in order to cool it. Mixing takes place in a venturi diffuser or mixing device which enables a high induction ratio to be achieved. The system is more efficient and less costly to install and operate than the conventional systems. In one embodiment, some or all of the primary air may be drawn from the space, thereby avoiding the wasteful discharge of cold air to atmosphere.

13 Claims, 7 Drawing Figures

Figure 1:
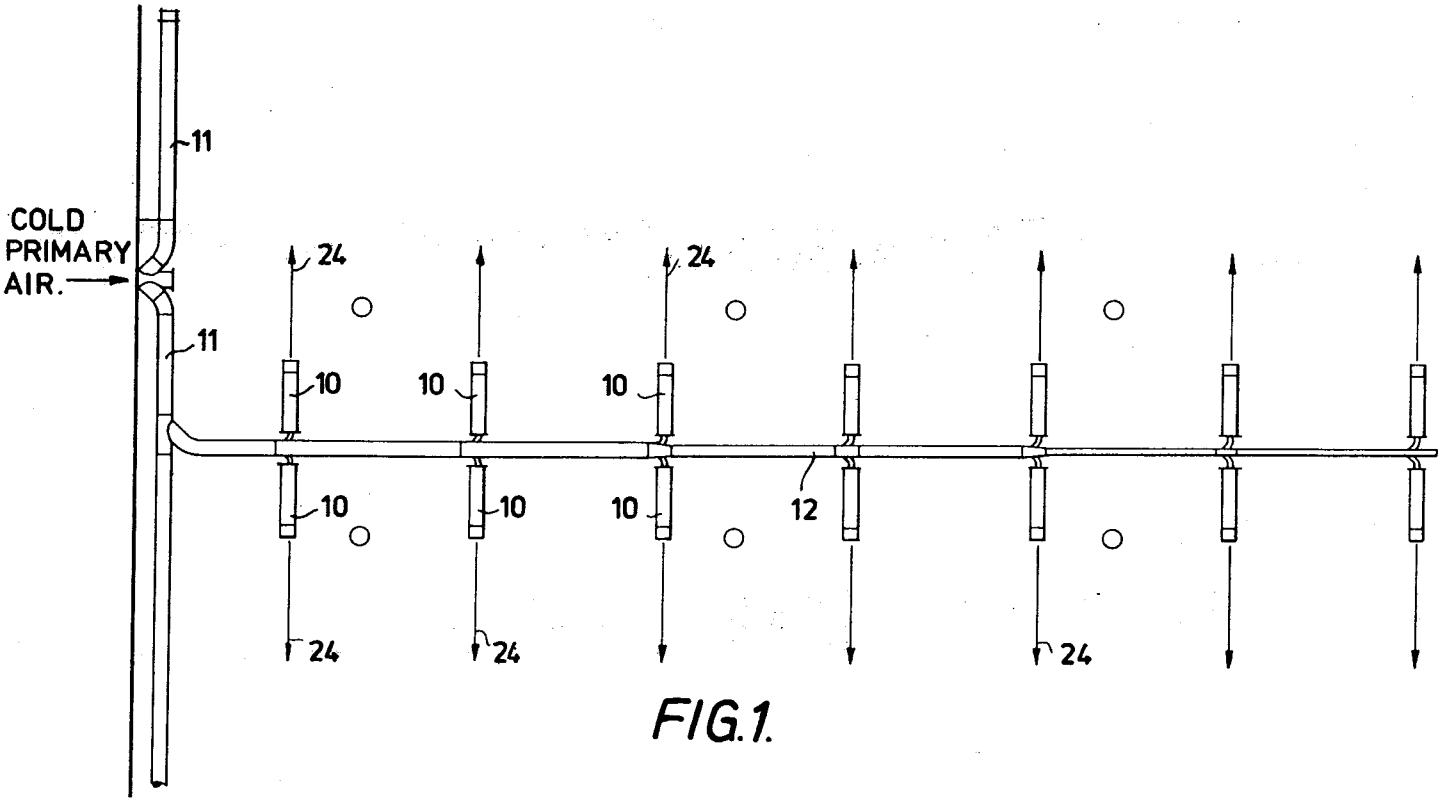

FIG.2a.
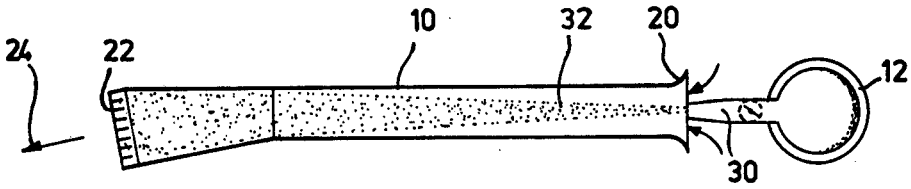
FIG.2b.
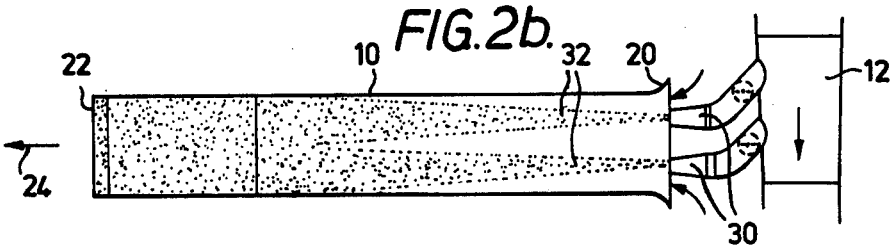
FIG.2c.
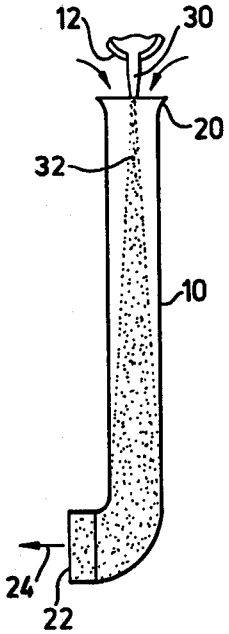
FIG.2d.
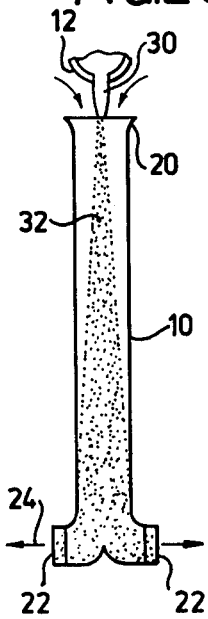
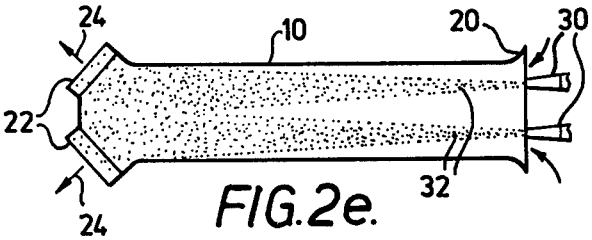
FIG.2e.

AIR CONDITIONING

This invention concerns improvements in and relating to air conditioning and more particularly to a method of an apparatus for cooling air in a space.

In conventional air conditioning or cooling systems the air in a space is constantly replaced by cooled air, the air in the space being discharged to atmosphere or some of the air being recirculated. Often the temperature of the air at discharge from the space is less than the surrounding temperature so that the discharge is wasteful. It is costly to recirculate air in the space because of the large volumes involved. All the air is passed through the central cooling plant.

Further, with such large volumes as are required for factories and warehouses, massive ducting for distribution and recirculation is necessary and the cost of insulating the distributing ducts becomes prohibitive.

The above is of particular importance in hot climates where a substantial temperature difference between the ambient air and the air in the space is desirable.

In another known air conditioning system primary air is piped from a central conditioning plant to separate low level or floor standing distributor units, within the space to be conditioned. Here the primary air is mixed with some secondary air drawn from the space and the mixture passes into the space. The secondary air is conditioned locally to produce a desired temperature and humidity in the final mixture, as it passes over heating or cooling coils before it is mixed with the primary air. Typically, when the desired conditions are 70° F and 50% relative humidity, the primary air is at less than dew point and the secondary air is cooled as it flows over the coils to the room dew point (i.e. sensible cooling only). The primary and secondary flows are at substantially the same temperature (say 55° F) and are mixed only to produce the desired humidity.

The problems set out above are equally applicable to such a system, although a smaller quantity of air is treated in the central primary air conditioning plant. In addition, it is necessary to distribute to the coils in the units, a heat exchange medium which needs to be heated or cooled in a second control plant. The heat exchange medium circuit and control plant add significantly both to the capital and running costs of the system.

Further, although in such a system there is some recirculation due to the induction of a secondary air flow; the induction efficiency is low partly because there is a pressure drop as air flows over the conditioning coils, before mixing.

In a system proposed over fifty years ago, and described in German patent specification No. 369,913, a jet of primary air passes from a pipe disposed in the middle of a recirculation duct. The downstream end of the duct opens into the space at high level and secondary air from the space is drawn into the duct at the upstream end, near the floor. Mixing of the primary and secondary air occurs in the region of the primary air pipe and the mixture then passes out into the space. Here again the induction efficiency is low.

Our British patent specification No. 1,316,887 describes space heating apparatus in which high temperature air supplied by an air heater is mixed with air drawn from the space to be heated and the mixture is then introduced into the space thereby to heat the space.

We have now found that considerable advantages accrue if air drawn from the space is mixed with a supply of much colder air, the mixture being introduced into the space in order to cool the space.

According to one aspect of this invention a method of cooling a space comprises cooling a supply of primary air to a temperature substantially below a desired temperature of the space, distributing the so-cooled primary air to a plurality of tubular venturi mixing devices or diffusers disposed at high level within the space and directing a jet of primary air into one end of each mixing device or diffuser so as to induce a flow of seconary air from the space directly into the diffuser and cause mixing with the primary air to produce a mixture which has a desired intermediate temperature and which flows out from the diffuser into the space.

It is considered that air should be discharged into the space at a temperature of about 10° F less than the desired temperature of the space.

In the past, when the total volume of air in the space was replaced by cool air, vast quantities of air had to be cooled from, say, 85° F to, say, 60° F. and much wastage occurred since air was discharged from the space at a temperature less than the temperature of ambient air.

Since we propose to mix cold air with air drawn from the space, the wastage is reduced and a much smaller quantity of air needs to be cooled to achieve the same cooling effect in the space.

Preferably, the temperature of the cooled primary air is in the region of 40° F which is considerably lower than the temperature at which conventional systems operate or other proposed systems could operate. The use of such a low temperature is advantageous since, because the air is cooled by a greater temperature difference, the refrigeration unit operates at higher efficiency than would otherwise be possible, thereby reducing running costs.

In conventional systems, to use a low temperature is impractical because of the discomfort caused to occupants of the space by blasts of cold air. With the present invention, low primary air temperatures are possible because sufficient secondary air, that is air drawn from the space, is mixed with the primary air to produce a desired intermediate temperature. Preferably, more secondary air than primary air is used. By using venturi diffusers such as described in our British patent specification No. 1,316,887, an induction ratio, that is the secondary : primary air ratio of 63:37 (by volume) can be achieved. Further induction of secondary air is local to the diffusers, that is to say, at the high level where the space air tends to be warmer.

According to another aspect of this invention, apparatus for cooling a space by the method according to the above mentioned aspect of the invention comprises a refrigeration unit for cooling a supply of primary air to a temperature substantially below a desired temperature of the space, and ducting for distributing the so-cooled primary air to terminating nozzles associated with a plurality of tubular venturi diffusers or mixing devices disposed at high level in the space, each nozzle being arranged to direct a jet of primary air into one end of an associated tubular venturi diffuser, so as, in use, to induce a flow of secondary air from the space directly into the diffuser and cause mixing with the primary air to produce a mixture which has a desired intermediate temperature and which flows into the space from the other end of the diffuser.

In one embodiment, each diffuser comprises a bell-mouthed inlet at one end and an outlet at the other, and has the same cross-section along the main part of its length. The nozzle is disposed at the entrance of the bell mouth to direct a jet of cold primary air into the diffuser. This induces a flow of secondary air from the space, through the bell-mouthed inlet and into the tube where it mixes with the primary air. Peak induction efficiency occurs when the axial position of the nozzle coincides with the entrance of the bell inlet.

The present invention enables a high rate of recirculation, which at peak induction efficiency is in the region of 63% (by volume), and because recirculation is localised the need for recirculation ducting is avoided. Since the quantity of primary air is less than, and preferably almost one third of that required in conventional systems, a smaller refrigeration plant can be used and less ducting is required for distribution of the primary air. Further, the ducting may be of smaller diameter when compared with the ducting used in prior art installations, and the resulting reduction in surface area gives rise to savings in the cost of insulation and greater efficiency.

It will be appreciated that the present invention affords considerable savings in both capital and running costs as compared with other installations.

Figure 3:
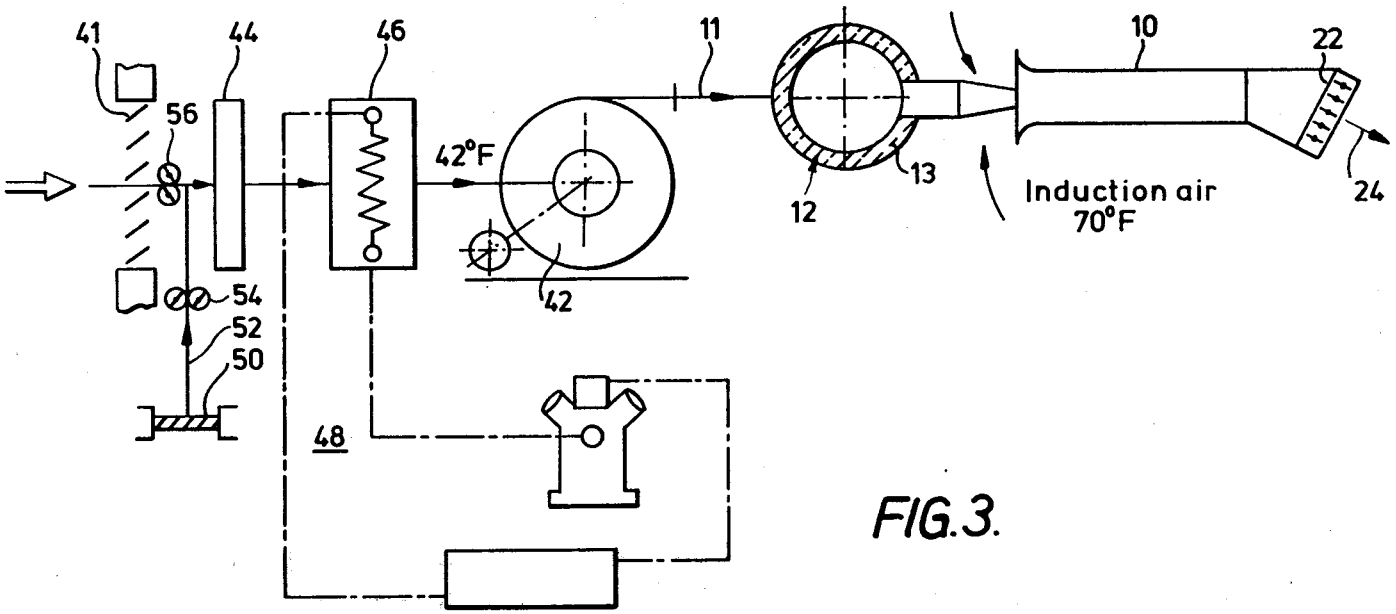

Embodiments of the invention will now be described, by way of example, with reference to the accompanying drawings, in which:

FIG. 1 shows a layout of an air conditioning installation;

FIGS. 2*a* to 2*e* show details of a number of different venturi diffusers; and FIG. 3 is a schematic layout of an air conditioning installation.

Referring to FIG. 1, a space is to be cooled by introducing air into the space from a plurality of venturi diffusers 10 which are located at a high level within the space. Cold, primary air is supplied through main ducts 11 and branch ducts 12 (one shown) and this primary air mixes with secondary air drawn from the space in a plurality of venturi diffusers or mixing devices 10 at intervals along the branch duct 12, each producing an outlet flow 24 of mixed primary and secondary air.

FIGS. 2*a* to 2*e* show details of a number of different kinds of diffusers or mixing devices. Each diffuser is tubular and has an inlet in the form of a bell-mouthed opening 20 at one end and an outlet or outlets 22 at the other. FIG. 2*a* is a schematic cross-sectional elevation and FIG. 2*b* is a cross-sectional plan view of a preferred embodiment of diffuser 10 which is rectangular in lateral cross-section. Two high velocity nozzles 30, connected to the branch duct 12 supplying cold primary air, are arranged on the major axis of the rectangular cross-section, at the entrance to the bell-mouthed opening 20, to direct jets 32 of cold primary air through the diffuser 10.

Many different diffuser designs may be used and other examples are shown in FIGS. 2*c* to 2*e*. The diffusers of FIGS. 2*d* and 2*e* are branched and have two outlets 22 to discharge cool air in different directions. FIGS. 2*c* and 2*d* show diffusers suitable for vertical mounting.

As shown in FIGS. 2*a* to 2*c* a high velocity jet of cold primary air 32 issues from each nozzle 30 through the venturi diffuser 10 and in so doing induces a flow of secondary air 36 directly from the space. This secondary air mixes with the primary air to produce a mixture at a desired intermediate temperature, and the outlet mixture 24 then passes through the outlet or outlets 22 into the space. With the nozzles 30 in the position shown, peak induction efficiency is achieved, the proportion of primary to secondary air being in the region of 37%:63%. If desired, the outlet of the diffuser 10 may be fitted with a cowl 38 and louvred grille 40 (FIG. 2*a*).

As the outlet mixture 24 passes into the space, further mixing occurs since air in the space is entrained and this further assists in the circulation of air within the space.

For a primary air flow of 1000 cu.ft./min. at a temperature of 42° F. and assuming the temperature of the secondary air to be 70° F., an outlet flow of 2700 cu.ft. of air per minute at a temperature of 59° F. is produced.

Referring now to FIG. 3, primary air at, say, 85° F. is drawn from a fresh air intake 41 by a high pressure centrifugal fan 42. It passes through an air filter 44 and over a cooling coil 46 in the refrigeration unit 48, to reduce its temperature to 42° F. After cooling, the fan pumps the air at high velocity along the main ducts 11 and branch ducts 12 covered with insulation 13 and through nozzles 30 to the plurality of diffusers 10 (one shown).

Recirculation of the air in the space is, therefore, localised so that the need to pump air back to the central cooling plant (as in the prior art) is avoided.

Primary air may also be drawn from the space to achieve greater recirculation by connecting an inlet 50 to the air filter 44. The proportion of fresh air from the intake 41 to recirculated air drawn via a pipe 52 from the space is controllable by means of dampers 54 and 56.

The system is controlled by a thermostat (not shown) so as to operate only when the temperature in the space exceeds a certain predetermined value.

What we claim is:

1. A method of cooling a space comprising providing tubular venturi mixing devices or diffusers having primary air nozzles, bell-mouthed secondary air inlets, and outlets for discharging mixed primary and secondary air into said space, said nozzles being disposed at the entrances of the secondary air inlets, and said mixing devices or diffusers and the inlets thereof being disposed at high level within the space; cooling a supply of primary air to a temperature substantially below a desired temperature of the space; distributing the so-cooled primary air to said nozzles into said secondary air inlets; inducing with said jets flows of secondary air from the high level in the space directly into the inlets; and forming a mixture of said primary air and secondary air in the devices or diffusers in which the volume of secondary air represents at least 50% of the total volume of mixed primary and secondary air discharged into the space through said outlets.

2. A method according to claim 1, wherein the primary air is cooled to a temperature in the region of 40° to 45° F.

3. A method according to claim 1, wherein the volume of induced secondary air is more than 50% of the total volume of air discharged into the space.

4. A method according to claim 3, wherein the volume of secondary air is in the region of 63% of the said total volume.

5. A method according to claim 1, wherein some of the primary air is drawn from the space.

6. A method according to claim 1 wherein the axial positions of the discharges of said nozzles coincide with the entrances of said inlets.

7. A method according to claim 1 wherein the combined streams of primary and secondary air are maintained at the same cross-section along the main part of the length of the mixing device or diffuser.

8. Apparatus for cooling a space by the method which includes cooling a supply of primary air to a temperature substantially below a desired temperature of the space, distributing the so-cooled primary air to a plurality of tubular venturi mixing devices or diffusers disposed at high level within the space and directing a jet of primary air into one end of each mixing device or diffuser so as to induce a flow of secondary air from the space directly into the diffuser and cause mixing with the primary air to produce a mixture which has a desired intermediate temperature and which flows out from the diffuser into the space, said apparatus comprising a refrigeration unit for cooling a supply of primary air to a temperature substantially below a desired temperature of the space, ducting for distributing the so-cooled primary air to terminating nozzles associated with a plurality of tubular venturi diffusers or mixing devices disposed at high level in the space, each nozzle being arranged to direct a jet of primary air into one end of an associate tubular venturi diffuser, so as, in use, to induce a flow of secondary air from the upper level in the space directly into the diffuser and cause mixing with the primary air to produce a mixture which has a desired intermediate temperature and which flows into the space from the other end of the diffuser.

9. Apparatus according to claim 8, wherein each tubular venturi diffuser has a bell-mouthed inlet at one end and an outlet at the other and has the same cross-section along the main part of its length and wherein the nozzle is disposed at the entrance of the bell-mouthed inlet.

10. Apparatus according to claim 9, wherein each diffuser is rectangular in cross-section and has two or more nozzles associated therewith and arranged side by side along the major axis of the rectangular cross-section.

11. Apparatus according to claim 8 and comprising a fresh air intake and a recirculation pipe communicating with the space, connected to the refrigeration unit for the supply thereto of primary air, and valve means for controlling the relative proportion of fresh air and recirculated air, in the primary air.

12. Apparatus according to claim 8, wherein the ducting comprises a main duct connected to the supply of cold primary air and one or more branch ducts along the length of each of which venturi diffusers are spaced at intervals.

13. Apparatus according to claim 8 wherein said one end of said tubular venturi diffusers or mixing devices is provided with an inlet for receiving said flow of secondary air, said jet of primary air is directed into said inlet through said terminating nozzles, and said nozzles have discharge outlets whose axial position coincides with the entrance of said inlet.

* * * * *